US005971419A

United States Patent [19]

Knapschafer

[11] Patent Number: 5,971,419

[45] Date of Patent: Oct. 26, 1999

[54] ROTATIONAL BINDING FOR A FREE STYLE SNOWBOARD

[76] Inventor: Myron L. Knapschafer, 4200 W. 23rd Ave., Denver, Colo. 80212

[21] Appl. No.: 08/847,643

[22] Filed: Apr. 30, 1997

Related U.S. Application Data

[60] Provisional application No. 60/018,008, May 21, 1996.

[51] Int. Cl.[6] ..... A63C 5/03; A63C 9/00

[52] U.S. Cl. ..... 280/607; 280/633; 280/14.2

[58] Field of Search ..... 280/633, 629, 280/617, 618, 14.2, 607

[56] References Cited

U.S. PATENT DOCUMENTS

| | | | |
|---|---|---|---|
| 2,955,300 | 10/1960 | Hedlund | 280/618 |
| 3,685,846 | 8/1972 | Schmid | 280/607 |
| 3,817,543 | 6/1974 | Haff | 280/607 |
| 3,917,298 | 11/1975 | Haff | 280/607 |
| 5,028,068 | 7/1991 | Donovan | 280/618 |
| 5,188,386 | 2/1993 | Schweizer | 280/607 |
| 5,615,901 | 4/1997 | Piotrowski | 280/7.14 |
| 5,803,467 | 9/1998 | Piotrowski | 280/7.14 |
| 5,813,688 | 9/1998 | Dacklin | 280/607 |

FOREIGN PATENT DOCUMENTS

| | | | |
|---|---|---|---|
| 398794 | 11/1990 | European Pat. Off. | 280/14.2 |
| 3338721 | 6/1984 | Germany | 36/117.5 |

*Primary Examiner*—Lanna Mai
*Assistant Examiner*—Bridget Avery
*Attorney, Agent, or Firm*—Edwin H. Crabtree; Ramon L. Pizarro; Donald W. Margolis

[57] ABSTRACT

A rotational boot binding for mounting on a free style snowboard. The binding allows the user of the snowboard to wear hard shell boots and while boarding rotate both feet in a vertical plane for shifting his or her weight to the toe or the heel of the board. The binding includes a base plate having a plurality of holes therein for attaching and adjusting the base plate at an angle from 30 to 120 degrees to an axis along a length of the snowboard and centered thereon. The base plate is attached to a foot plate by a horizontal pivot pin. The pivot pin allows the foot plate to rotate on the base plate in a vertical plane thereby allowing a shift of weight to the toe or to the heel of the snow board and thus control the movement of the snowboard. The binding includes a toe base plate, a toe foot plate, a heel base plate and a heel foot plate. By having separate toe plates and heel plates, the binding can be adjusted on the snowboard for a wide range of different lengths of boot. A pair of the subject bindings for the front foot and the rear foot are mounted on the snowboard for different types of foot stances such as a duck foot stance. Also, the bindings can be used for a regular foot mounting with the left foot forward on the snowboard or a goofy foot mounting with the right foot forward on the snowboard.

14 Claims, 2 Drawing Sheets

ROTATIONAL BINDING FOR A FREE STYLE SNOWBOARD

This utility patent application is based on a provisional application filed by the subject inventor on May 21, 1996 and having Ser. No. 60/018,008.

BACKGROUND OF THE INVENTION (a) Field of the Invention

This invention relates to ski and snowboard bindings and more particularly, but not by way of limitation, to a snowboard boot binding for a free style snowboard.

(b) Discussion of Prior Art

The snowboard was first developed and patented by an inventor from Michigan in the mid 1960's. The patent was sold to a company called Brunswick-Baldwin who in turn sold the rights to Jake Burton Carpenter who makes a Burton snowboard.

Snowboards didn't catch on until the very early 1980's when Sims Skateboard Company and Burton Snowboard Company saw the possibility of using a "skateboard" on the ski slopes. Since there was already a pool of several million young skateboarders in the United States, the rest is now history as to this new popular outdoor winter sport.

Almost all free style snowboards today resemble a modified mono ski with a ski tip and ski tail turned up and the boot bindings placed on the snowboard sideways a la skateboard style. Snowboarding being a mountain sport and initially riding in snow powder only, it was natural for the user of the snowboard, predominantly a skateboarder, to wear soft winter boats such as a trade brand sold by the name of SORRELS. Plastic bindings, even though many of them broke, seemed to fit the bill for snowboards and even after groomed ski slopes were opened to snowboarders, the plastic bindings and soft winter boots continued to be used. While the snowboard industry is addressing the plastic binding problem by going to a step-in soft boot, the problem of protecting feet and ankles remains.

Attempts to use regular hard shell ski boots have been unsuccessful because the boot, which has a flat sole, is fastened flat to the top of the snowboard and the user is unable to shift his or her weight to the toe or heel of the board when standing sideways on the board when free style boarding. The shifting of the weight to the toe or heel of the board is necessary to control the board and is easy to do in soft winter boots. But soft winter boots provide less control and no protection for injuries to a boarder's feet and ankles. In fact, the term "snowboarders fracture" is now in common usage when referring to a broken ankle by a snowboarder.

In U.S. Pat. No. 5,558,354 to Lion, a combination ski and binding plate assembly is described. In this patent, a front linkage and a rear linkage are used to shift weight from one ski to the other ski. U.S. Pat. No. 4,403,785 to Hottel describes a monoski having releasable bindings. The bindings allow the skier to rotate his or her feet and pivot the feet up and down.

U.S. Pat. No. 4,848,781 to Dykema et al. describes a snowboard that has a support deck that allows a user to pivot a foot along a longitudinal axis of the board but not side to side in a vertical plane. U.S. Pat. Nos. 2,593,974 and 2,564,420 to Brown disclose ski sleds that allow the user's foot to pivot up and down but not side to side. U.S. Pat. No. 4,741,550 to Dennis, U.S. Pat. No. 5,558,355 to Henry and U.S. Pat. No. 5,580,077 to Dodge describe different types of snowboard bindings but not the features of the subject invention.

None of the above mentioned patents individually or in combination disclose or teach the unique structure, the function, advantages and benefits of the rotational boot binding for a snowboard as described herein.

SUMMARY OF THE INVENTION

In view of the foregoing, it is a primary object of the subject invention to provide a boot binding for a snowboard that will allow the user of the board to be able to rotate the boot bindings using hard shell ski boots and any other type of hard shell boot for allowing a shift of weight to a toe and to a heel of the snowboard and thus control the movement of the snowboard when boarding downhill. The rotation of the bindings have a low center of gravity for greater control of the snowboard when compared to using the rotation of the snowboarders ankles. The use of the ankle for rotation having a high center of gravity when measured from the top of the board to the ankle.

Another object of the new rotational bindings is to allow a user of the snowboard to wear hard shell boots for greater ankle and foot protection and control when boarding on a snowboard. The bindings eliminate the need for wearing soft boots and the use of plastic bindings which have been found to be not reliable in cold weather. Plastic bindings also age rapidly, become brittle and brake.

Still another object of the invention is the bindings are readily adaptable to various types of snowboards and can be secured at various angles to an axis running along a length of the snowboard. The bindings are adjustable for different foot sizes and different stances used on the snowboard. Also the bindings are adjustable as to the amount of rotational movement of the boots on the binding in a vertical plane.

The subject snowboard binding includes a base plate having a plurality of holes therein for attaching and adjusting the base plate at an angle from 30 to 120 degrees to an axis along a length of the snowboard and centered thereon. The base plate is attached to a foot plate by a horizontal pivot pin. The pivot pin allows the foot plate to rotate on the base plate in a vertical plane thereby allowing a shift of weight to the toe or to the heel of the snowboard at a much lower center of gravity and thus improving control of the movement of the snowboard. The binding includes a toe base plate, a toe foot plate, a heel base plate and a heel foot plate. By having separate toe plates and heel plates with dual hole spacing, the binding can be adjusted on the snowboard for a wider range of boot length. Also the binding includes bumpers that are disposed on opposite sides of the base plate for engaging the bottom of the foot plate and for adjusting the amount of vertical rotation travel of the foot plate on the baseplate. A pair of the subject bindings are mounted on the snowboard for different types of foot stances such as a duck foot stance. Also, the bindings can be used for a regular foot mounting with the left foot forward on the snowboard or a goofy foot mounting with the right foot forward on the snowboard.

These and other objects of the present invention will become apparent to those familiar with ski bindings and bindings for snowboards from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
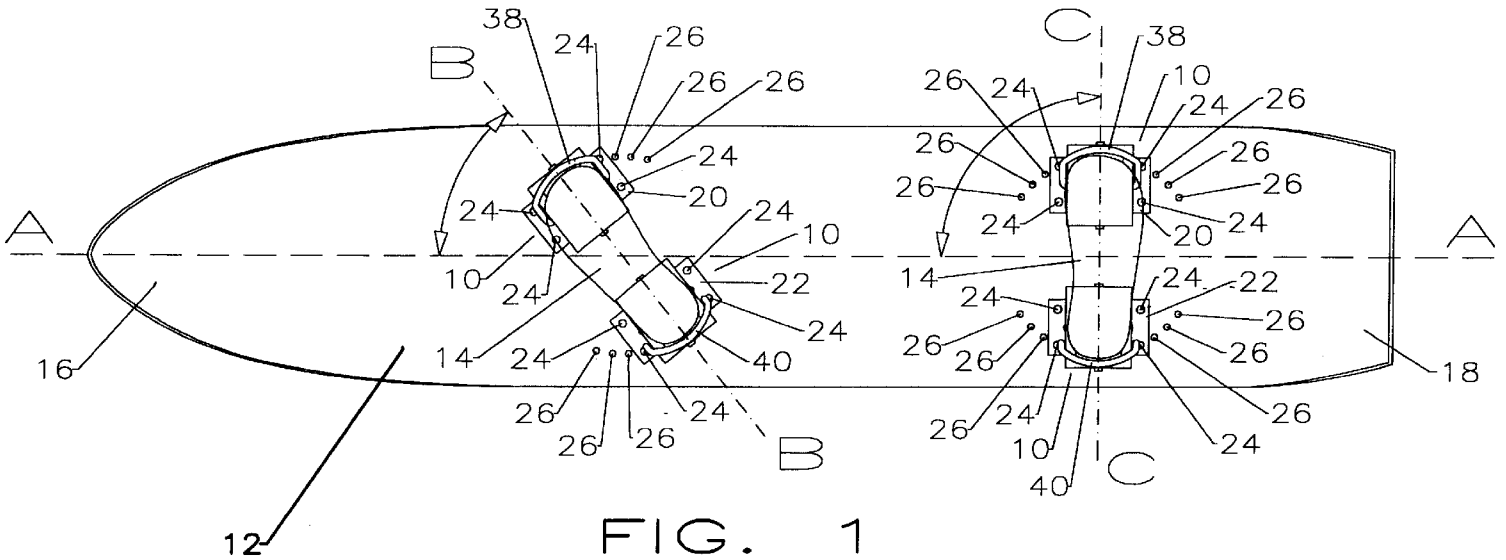
FIG. 1 is a top view of a typical snowboard with a front hard shell boot and binding disposed at a 45 degree angle from a horizontal axis along a center line A—A the length of the snowboard. A rear boot and binding are disposed at a 90 degree angel from the center line A—A.

In FIG. 1, the subject rotational boot bindings for free style snowboarding is designated by general reference numeral 10. While a single binding 10 is described herein, it should be kept in mind that a pair of bindings 10 for a front foot and a rear foot will be used on a snowboard. The snowboard is shown having a general reference numeral 12. In this drawings, the left foot of a snowboarder would be received in a typical hard shell boot 14 and placed in the front binding 10 which is closest to a toe 16 of the snowboard 12 and the right foot of a boarder would be received in a boot 14 in the rear binding 10 which is closest to a heel 18 of the snowboard. The boot 14 may be a typical hard shell ski boot, a modified extended height hard shell binding with adapter plate for receiving a soft boot, other types of boots used for winter sports, hiking boots and the like.

It should be noted at the outset, a free style rider of the snowboard 12 places his or her feet across the snowboard 12 much like a skateboarder, a surfer or a sail boarder. In down hill boarding, snowboard racing and slalom boarding, the boot bindings will be positioned on the snowboard more parallel to the length of the snowboard. For example, the bindings positioned at 10 to 20 degrees from the center line through the length of the board. In snow skiing, the ski boot bindings are mounted parallel to the length of the ski.

In FIG. 1, the snowboard 12 is shown with a horizontal axis along a center line A—A through the length of the board. A horizontal axis of a center line B—B is shown drawn through the front boot 14 and the front binding 10. The front binding 10 is shown positioned on the snowboard 12 at an angle of 45 degrees. The angle of the front binding 10 to the boards center line A—A may be in a range of 30 to 90 degrees. The front binding 10 includes a toe base plate 20 and a heel base plate 22 having a series of holes 24 therein for matching with a plurality of holes 26 in the top of the snowboard 12. By rotating the holes 24 of the base plates 20 and 22 with matching holes 26 on the board, the desired angle of the front binding 10 can be chosen. Likewise, The rear binding 10 also includes a toe base plate 20 and a heel base plate 22 having a series of holes 24 therein for matching with a plurality of holes 26 in the top of the snowboard 12. By rotating the holes 24 of the base plates 20 and 22 with matching holes 26 on the board, the desired angle of the rear binding 10 can be chosen.

The rear binding 10 and boot 14 are shown in FIG. 1 disposed along a horizontal axis along a center line C—C and at a 90 degree angle from the center line A—A. The rear binding 10 and boot 14 may be adjusted at an angle from the center line A—A in a range of 60 to 120 degrees. Should the boarder choose to have his or her front foot at an angle of 45 degrees from the center line A—A and the rear foot at an angle outward toward 120 degrees from the center line A—A then the riders stance would be in the form of a "duck foot". obviously, by adjusting the front and rear bindings at various angles as mentioned above, the snowboarder may choose various stances for his or her feet on the snowboard 10.

In FIG. 1, the bindings 10 are shown mounted on the snowboard 12 for a regular foot mounting with the left foot forward on the snowboard 12. Also the bindings 10 can be reversed in direction 180 degrees on the board and attached thereto for what is called a "goofy foot" mounting wherein the right foot is forward on the snowboard 12 and the left foot is the toward the heel 18 of the snowboard 12.

Figure 2:
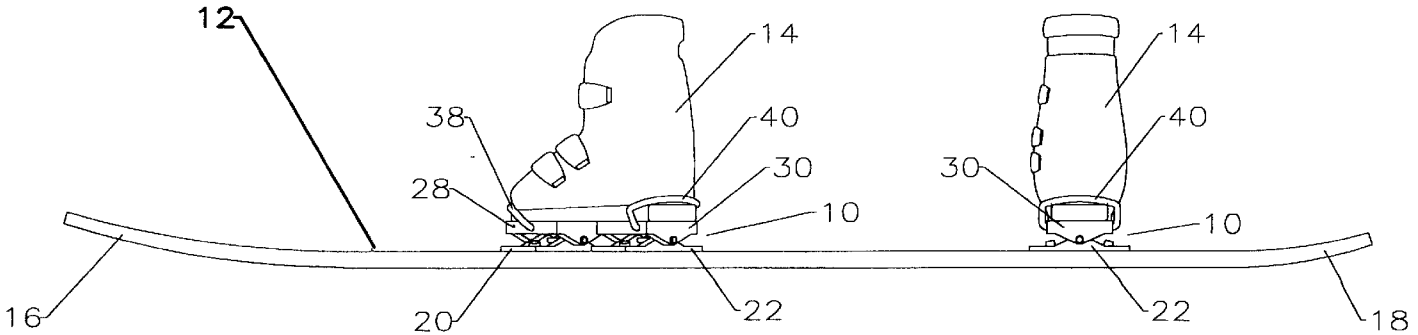
FIG. 2 is a side view of the snowboard shown in FIG. 1 with the snowboard having an upwardly turned toe and an upwardly turned heel. In this drawing, a rear view of the hard shell boots and bindings are shown.

In FIG. 2 a side view of the snowboard 12 as shown in FIG. 1 is illustrated. In this view, the snowboard 12 can be seen with the upwardly turned toe 16 and the upwardly turned heel 18. Also shown in this drawing is the front and rear bindings 10 having a toe foot plate 28 pivotally mounted on the toe base plate 20 and a heel foot plate 30 pivotally mounted on the heel base plate 22. The front and rear bindings 10 for both feet are interchangeable and the only difference is the front bindings 10 normally will be mounted on the snowboard 12 at a different angle than the rear bindings 10 as shown in FIG. 1. The use of the toe foot plate 28 and the toe base plate 20 being separate from the heel foot plate 30 and the heel base plate 22 allows for increasing the adjustment of the bindings for different lengths of boots 14 on the snowboard 12. Also, it can be appreciated that a single foot plate pivotally mounted on a single base plate is an option where an adjustment for different lengths of boots is more limited. The toe foot plate 28 and the toe base plate 20, attached to the rear boot 14, can not be seen in this drawing because of the angle of the binding 10 mounted on the snowboard 12 as shown in FIG. 1.

Figure 3:
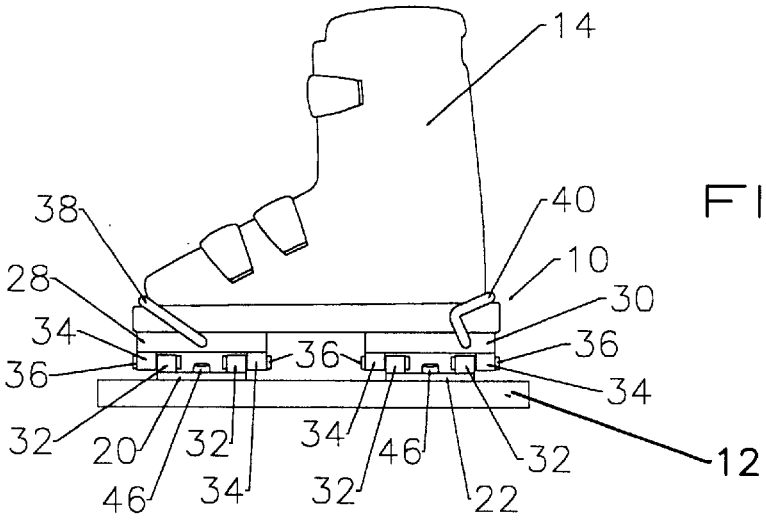
FIG. 3 is an enlarged side view of one of the hard shell boots mounted on the subject vertical rotational boot binding.

In FIG. 3, the toe base plate 20 and the heel base plate 22 are shown with upwardly extending base plate ears 32. The toe foot plate 28 and the heel base plate 30 in turn are shown with downwardly extending foot plate ears 34. The base plate ears 32 and the foot plate ears 34 are indexed next to each other for receiving a pivot pin 36 through holes in the ears 32 and 34. The holes in the ears 32 and 34 are not shown in the drawings. The pivot pin 36 allows the toe and heel foot plates 28 and 30 to rotate on the toe and heel base plates 20 and 22 in a vertical plane about a horizontal axis such as along the center lines B—B and C—C shown in FIG. 1.

In FIGS. 1–4, the drawings show the toe and heel foot plates 28 and 30 with a hard wire toe bale 38 and a hard wire heel bale 40 used for engaging the toe and heel of the boot 14 and securing the boot 14 to the top of the foot plates 28 and 30. While the bales 38 and 40 are shown in the drawings, it should be kept in mind that a variety of different types of boot engaging devices can be used with the subject invention.

Figure 4:
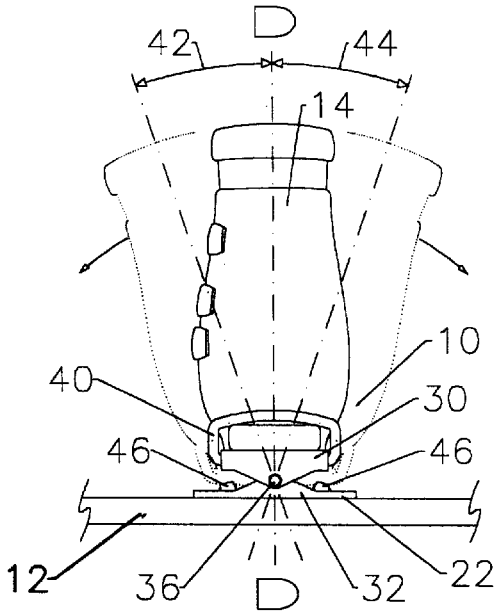
FIG. 4 is an enlarged rear view of the boot shown in FIG. 3 and illustrating the rotational movement in a vertical plane of the boot and the bindings foot plate.

In FIG. 4, an enlarged rear view of the boot 14 shown in FIG. 3 is illustrated showing rotational movement in a vertical plane to the left and to the right of a vertical center line D—D through the center of the pivot pin 36. The rotational movement in a vertical plane may be up to 15 degrees or greater to the left as indicated by arrow 42 and may be up to 15 degrees or greater to the right as indicated by arrow 44.

It should be noted that the placement and rotation of the bindings 10 provide a low center of gravity. The low center of gravity being the distance between the top of the snowboard 12 and the center of the pivot pin 36. This distance is in a range of ½ to 1 inches. The low center of gravity using the bindings 10 provides for greater control of the snowboard 12. The benefit of the low center of gravity and greater control of the snowboard 10 is a marked improvement when compared to a higher center of gravity of a snowboarder using his or her ankles of board control rotation using soft winter boots. The typical distance from the top of the snowboard 12 to the boarders ankles being in a range of 4 to 5 inches.

Figure 5:
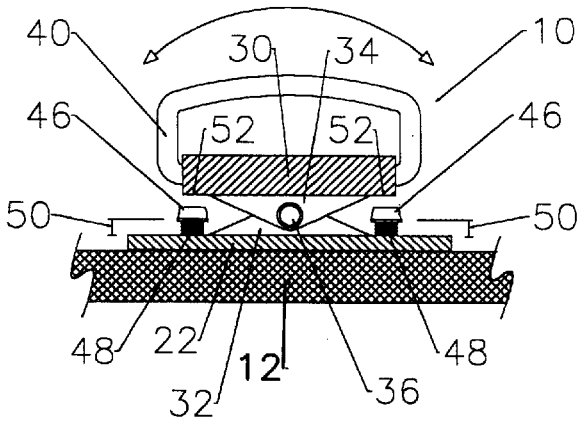
FIG. 5 is an enlarged rear sectional view of one of the bindings foot plate and showing adjustable bumpers threaded into the top of opposite sides of a base plate for controlling the rotational movement of the foot plate.

In FIG. 5, an enlarged rear sectional view of one of the heel base plates 22 is shown with a portion of the heel foot plate 30 cut away to illustrate a pair of rubber bumpers 46 mounted on threaded screws 48 adjustably mounted in the top of opposite sides of the base plate 22. It should be noted that both the heel base plates 22 and the toe base plates 20 include the rubber bumpers 46 and screws 48. By adjusting the length of the bumpers 46 up and down, as indicated by arrows 50, the amount of rotation of the front and rear bindings 10 to the left or right in a vertical plane can be controlled when the bumpers 46 engage a bottom portion 52 of the foot plates 28 and 30 as they rotate on the pivot pin 36.

In the controlling of the amount of rotation and the shifting of the weight to the toe 16 or heel 18 of the snowboard 12, the bumpers 46 are screwed downwardly for greater rotation such as 15 degrees or greater from the vertical as shown in FIG. 4. Should the boarder wish less vertical rotation, for example when the bindings 10 are mounted more parallel and at less of an angle to the axis of the center line A—A, then the bumpers 46 would be screwed upwardly to restrict the amount of rotation to the left or right when the foot plates 28 and 30 pivot on the base plates 20 and 22. In this example, the amount of rotation might be limited to 5 to 10 degrees from the vertical. While the bumpers 46 are shown threaded into the top of the heel base plate 22 and the toe base plate 20, it can be appreciated that the bumpers 46 could also be screwed into the bottom of the toe foot plate 28 and heel foot plate 30 for engaging the base plates 20 and 22 and work equally well in controlling the amount of vertical rotation of the binding 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A rotational boot binding for mounting on a free style snowboard, the snowboard having a horizontal axis along a length of a center line of the snowboard, the binding receiving a boot releasably secured thereon, the binding comprising:

a base plate adapted for mounting on the snowboard, said base plate positioned on the snowboard at an angle to the horizontal axis of the center line of the snowboard;

a foot plate pivotally mounted on said base plate, said foot plate rotating in a vertical plane on said base plate, said foot plate adapted for receiving the boot thereon; and a pair of rubber bumpers mounted on opposite sides of said base plate, said bumpers engaging a portion of said foot plate for limiting the amount of rotation of said foot plate, said rubber bumpers adjustable on said base plate for adjusting the amount of rotation of said foot plate.

2. The binding as described in claim 1 wherein said foot plate is rotatable in the vertical plane of 0 to 15 degrees from an axis of a vertical center line through the center of said base plate.

3. The binding as described in claim 1 wherein said base plate is positioned on the snowboard at an angle of 30 degrees and greater from the horizontal axis of the center line of the snowboard.

4. The binding as described in claim 1 wherein said base plate is positioned on the snowboard at an angle in a range of 30 to 120 degrees from the horizontal axis of the center line of the snowboard.

5. A rotational boot binding for mounting on a free style snowboard, the snowboard having a horizontal axis along a length of a center line of the snowboard, the binding receiving a boot releasably secured thereon, the binding comprising:

a toe base plate and a heel base plate adapted for mounting on the snowboard, said toe base plate and said heel base plate positioned on the snowboard at an angle to the horizontal axis of the center line of the snowboard;

a toe foot plate pivotally mounted on said toe base plate, a heel foot plate pivotally mounted on said heel base plate, said toe foot plate rotating in a vertical plane on said toe base plate, said heel foot plate rotating in a vertical plane on said heel base plate, said toe foot plate and said heel foot plate adapted for receiving the boot thereon;

a first pair of rubber bumpers mounted on opposite sides of said toe base plate and a second pair of rubber bumpers mounted on opposite sides of said heel base plate, said bumpers engaging a portion of said toe foot plate and a portion of said heel foot plate for limiting the amount of rotation of said toe foot plate and of said heel foot plate, said rubber bumpers adjustable on said toe base plate and on said heel base plate for adjusting the amount of rotation of said toe foot plate and of said heel foot plate.

6. The binding as described in claim 5 wherein said toe base plate and said heel base plate are positioned on the snowboard at an angle of 30 degrees and greater from the horizontal axis of the center line of the snowboard.

7. The binding as described in claim 5 wherein said toe base plate and said heel base plate are positioned on the snowboard at an angle in a range of 30 to 120 degrees from the horizonal axis of the center line of the snowboard.

8. The binding as described in claim 5 wherein said toe foot plate and said heel foot plate are rotatable in a vertical plane of 0 to 15 degrees from an axis of a vertical center line through the center of said toe base plate and said heel base plate.

9. The binding as described in claim 5 wherein a distance from an axis of rotation of said toe foot plate and said heel foot plate on said toe base plate and said heel foot plate to the top of the snowboard is in a range of ½ to 1 inches for providing a low center of gravity and greater control in the movement of the snowboard.

10. A rotational boot binding for mounting on a free style snowboard, the snowboard having a horizontal axis along a length of a center line of the snowboard, the binding receiving a boot releasably secured thereon, the binding comprising:

a base plate adapted for mounting on the snowboard, said base plate positioned on the snowboard at an angle to the horizontal axis of the center line of the snowboard;

a foot plate pivotally mounted on said base plate, said foot plate rotating in a vertical plane on said base plate, said foot plate adapted for receiving the boot thereon; and a pivot space disposed on opposite sides of said base plate and between a top portion of said base plate and a bottom portion of said foot plate, said pivot space providing freedom of movement in allowing said foot plate to pivot on said base plate.

11. The binding as described in claim 10 wherein said foot plate is rotatable within said pivot space in the vertical plane and in a range of 5 to 15 degrees from an axis of a vertical center line through the center of said base plate.

12. The binding as described in claim 10 wherein said base plate is divided into a toe base plate and a heel base plate and said foot plate is divided into a toe foot plate and a heel foot plate, said toe foot plate pivotally mounted on said toe base plate, said heel foot plate pivotally mounted on said heel base plate.

13. The binding as described in claim 10 wherein said base plate is positioned on the snowboard at an angle of 30 degrees and greater from the horizontal axis of the center line of the snowboard.

14. The binding as described in claim 10 wherein said base plate is positioned on the snowboard at an angle in a range of 30 to 120 degrees from the horizontal axis of the center line of the snowboard.

* * * * *